US005443233A

United States Patent [19]

Kabanek

[11] Patent Number: 5,443,233

[45] Date of Patent: Aug. 22, 1995

[54] ARM BOARD FOR GURNEY

[76] Inventor: Joseph Kabanek, 32390 IH-10 West, Boerne, Tex. 78006

[21] Appl. No.: 174,258

[22] Filed: Dec. 28, 1993

[51] Int. Cl.[6] ..... B68G 5/00

[52] U.S. Cl. ..... 248/118; 5/646

[58] Field of Search ..... 248/118; 5/937, 623, 5/646, 647; 128/878; 297/188.18, 188.14, 188.2

[56] References Cited

U.S. PATENT DOCUMENTS

| | | | |
|---|---|---|---|
| 2,477,898 | 8/1949 | Rehman | 297/188.18 X |
| 2,605,152 | 7/1952 | Krewson | 5/646 |
| 2,609,261 | 9/1952 | Parker | 5/646 |
| 2,871,074 | 1/1959 | Malerich | 5/647 |
| 2,910,259 | 10/1959 | Johnson | 5/646 X |
| 4,045,011 | 8/1977 | Ford | 5/646 |
| 5,136,743 | 8/1992 | Cruz | 128/878 |
| 5,228,457 | 7/1993 | Kawamura | 5/647 X |
| 5,327,912 | 7/1994 | Mally | 128/878 X |

*Primary Examiner*—J. Franklin Foss
*Attorney, Agent, or Firm*—Paul H. Gallagher

[57] ABSTRACT

A flat stiff and strong board having an inner end under the patient on a gurney, and an outer end extending laterally beyond one side of the gurney. The outer end supports the arm of the patient. The board has spaced legs forming the inner end thereof, and conformations in its outer end facilitating handling thereof, and positioning of attendants and supporting a basin.

4 Claims, 2 Drawing Sheets

ARM BOARD FOR GURNEY

SUMMARY OF THE INVENTION

The invention resides in the broad field of treating a patient, and specifically providing emergency treatment to a patient on a gurney.

In giving emergency treatment, it is of course desirable that such treatment be given as soon as possible, and under such conditions as to make it as comfortable or the least irritating for the patient. In many cases, if not most cases, a patient is given treatment while he is still on the gurney, in order to treat the patient as soon as possible. However, in so treating the patient, difficulties arise because of confined space, or minimum space, on the gurney.

An object therefore of the present invention is to provide an arm board that can be applied to a gurney, to form a support for the arm of the patient, at a position beyond the confines of the gurney.

The device of the invention includes the following features and advantages:

(1) It is extremely simple and very easily applied to the gurney.

(2) It is held in place by the weight of the patient.

(3) It extends laterally beyond the edge of the gurney so that it is positioned for supporting the arm of the patient in the best position for treatment of the arm.

(4) Its simple design and construction renders it very light in weight so that it can be easily and quickly handled, and stored in a small space when not in use, and its simple construction renders it easy to manufacture, and correspondingly inexpensive.

(5) The arm board can be easily applied to and used with any of a wide variety or kinds of gurneys.

BRIEF DESCRIPTION OF THE INDIVIDUAL FIGURES OF THE DRAWINGS

DETAILED DESCRIPTION

Figure 8:
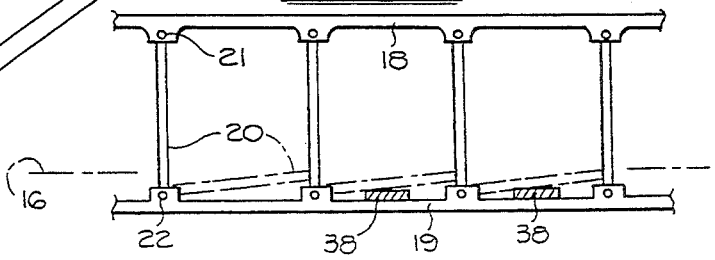
FIG. 8 is a view similar to FIG. 5 but with the side rail of the gurney in raised position.

The arm board of the invention is indicated in its entirety at 10, and the gurney with which it is used is indicated at 12. The gurney is a wheeled cart, for supporting the patient, and moving him about. The cart includes a base structure 13, and a bed 14 similar to a simple table top. A cushion 15 is placed on the bed and the cushion takes part in supporting the arm board as described below. The cushion is releasibly held in position on the bed by strips 16 (FIGS. 3, 5) of adhesive material that normally extend transversely of the bed and are spaced apart longitudinally thereof. The arm board is designed to accommodate these adhesive strips, as well as other elements as described below. Gurneys are produced by various companies, in different forms, but all of them are generally similar to the one disclosed here in that they include side rails 17 swingable from a lower inactive position shown in FIGS. 4–6 to an upper active position (FIGS. 3 and 8) in which they form walls at the sides of the gurney to prevent the patient from falling off. The side rails are put in upper active position when the patient is being moved about, but when the patient is to be treated, the side rails are swung down to inactive position.

The details of the base structure 13 of the gurney need not be shown or described in detail, since the use of the arm board concerns only that portion of the gurney that includes the bed and positioning of the side rails in upper and lower positions, and the cushion on the bed.

Each side rail includes upper and lower horizontal rail elements 18, 19 and a plurality of horizontally spaced bars 20 pivotally connected at their ends to the rail elements on the respective axes 21, 22. The lower rail element is fixed, as a part of the frame of the gurney, and the upper rail element is carried by the bars 20. The bars are pivoted in the lower rail element and are swingable to an upper vertical position (FIG. 8), and the upper rail element is correspondingly elevated. Thus the side rail 17 is swingable between the upper active position of FIG. 8 and a lower inactive position of FIGS. 4–6. In the latter position the bars 20 are adjacent the horizontal, although angularly displaced therefrom at a small angle. The upper, swinging end of each bar rests on, or above, the lower end of the next adjacent bar.

The spacing of these bars, along the side rail, and their positions in the active and inactive positions are referred to here in connection with the adaptability of the arm board to be applied to the gurney, with the side rails either in upper active position, or lower inactive position. Reference to this relationship will be made again hereinbelow, following the detailed description of the arm board itself.

The gurney, i.e. the bed 15, is elongated for conveniently accommodating the patient. Preferably the bed is made as narrow as practicable for convenience in treating the patient, and because of its narrow dimension, there is corresponding small space beyond the outline of the patient's body for his arm to be placed; for example, the arm would be positioned on the edge of the bed next to the patient's body. The principal feature of the present invention is that the arm board is positioned at the side of the gurney, and it extends laterally outwardly therefrom, so that the arm is therefore not positioned on the bed proper, but on the arm board.

Figure 7:
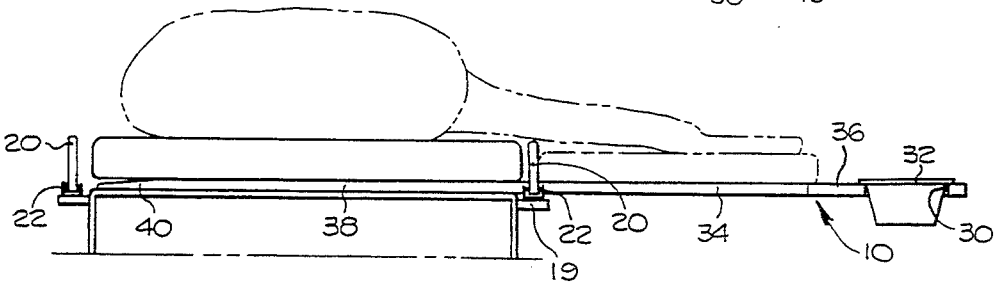
FIG. 7 is a transverse vertical view, of semi-diagrammatic nature, showing the upper part of the gurney, and the arm board, with a patient on the gurney.

Referring to the details of the arm board 10, it is in the form of a panel relatively long and of convenient width. It is rigid, and may be made of any convenient material, providing the desired rigidity, and necessary strength, e.g. plywood or plastic. The arm board may be referred to as having a near, or inner, end 23, and a remote, or outer, end 24. At the outer end, the arm board includes a portion 26, which constitutes the major portion of the board, and is generally continuous, except for certain holes. These holes include side slots 28 forming convenient hand grips, and a round hole 30 adjacent the outer end, for receiving a basin 32 (FIG. 7). The portion 26 at its side edges includes indentations 34 which form corresponding relatively wider elements 36. These side edge formations are not critical as to their size or location, but are generally formed and located for providing maximum width, at the elements 36, to provide corresponding greater width for facilitating the treatment. The indentations at 34 provide closer working space in the treatment of the patient.

Figure 1:
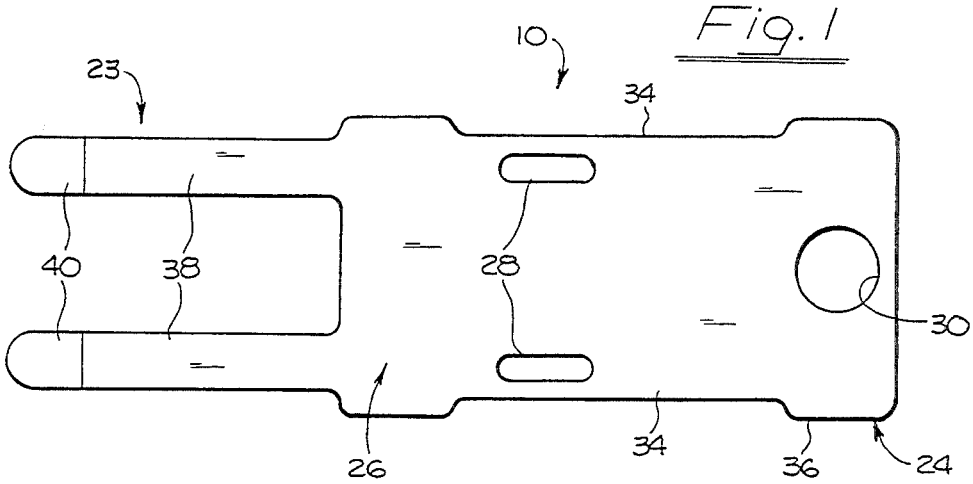
FIG. 1 is a face view of the arm board of the invention.
Figure 2:
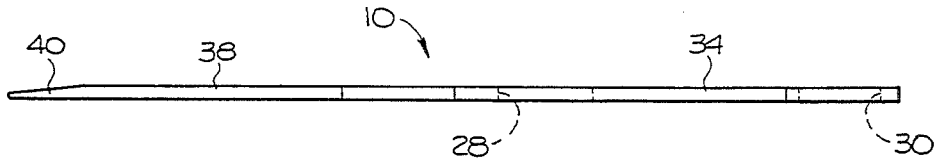
FIG. 2 is an edge view.

The arm board at its near end 23 is provided with a pair of laterally spaced legs 38 which are preferably quite narrow relative to the overall width of the board. Also preferably, the extended ends of these legs, i.e. at the near end 23, or left end as in FIGS. 1 and 2, are of wedge shape, at 40. The arm board is flat and assumes a uniform thickness throughout its entirety except at the wedge elements 40. The board may be for example ½" thick for facilitating insertion of it in position on the gurney as referred to again hereinbelow, the wedge elements 40 facilitating this action.

Figure 3:
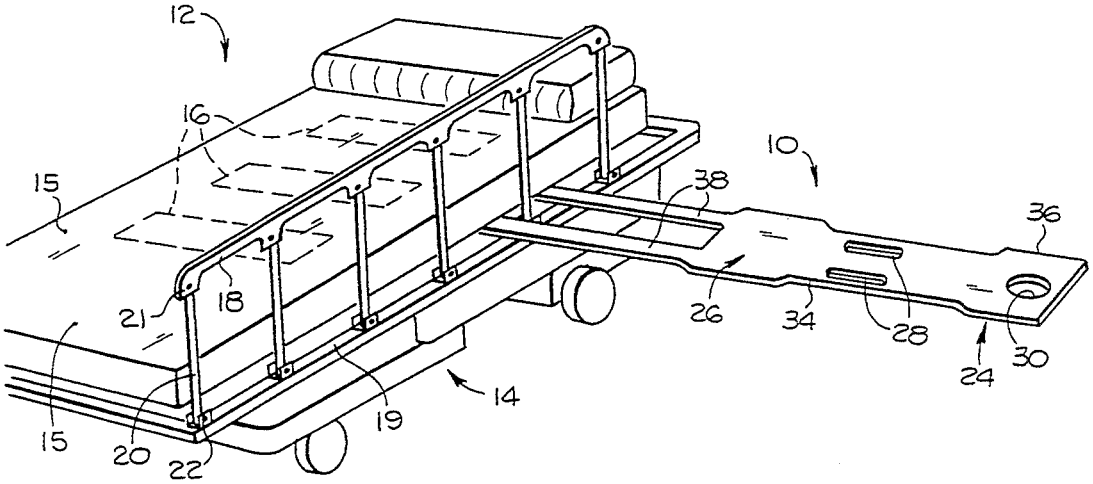
FIG. 3 is a perspective view showing a first step in placing the arm board in position on the gurney.
Figure 4:
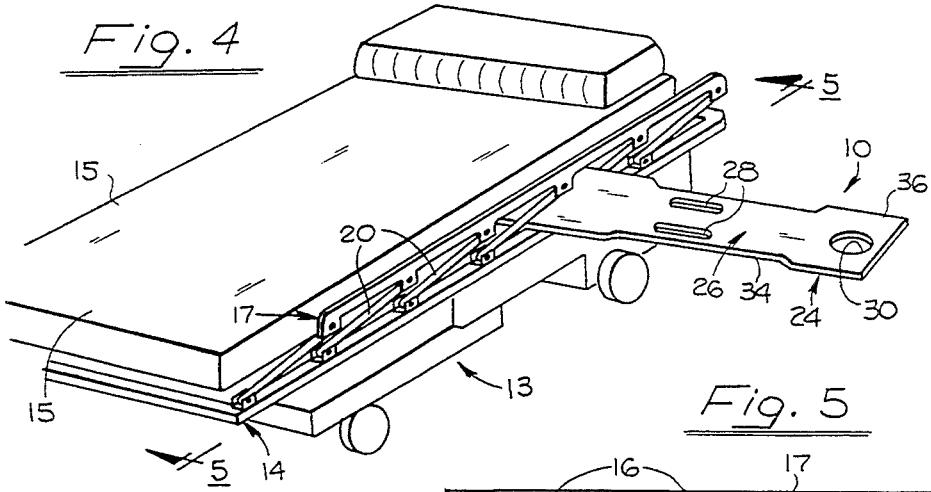
FIG. 4 is a view similar to FIG. 3 but with the arm board fully in position.
Figure 5:
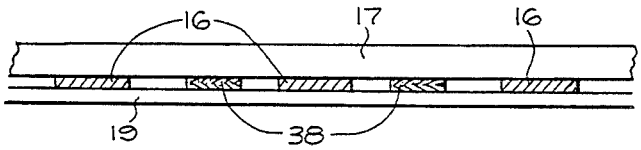
FIG. 5 is a fragmentary view taken at line 5—5 of FIG. 4.
Figure 6:
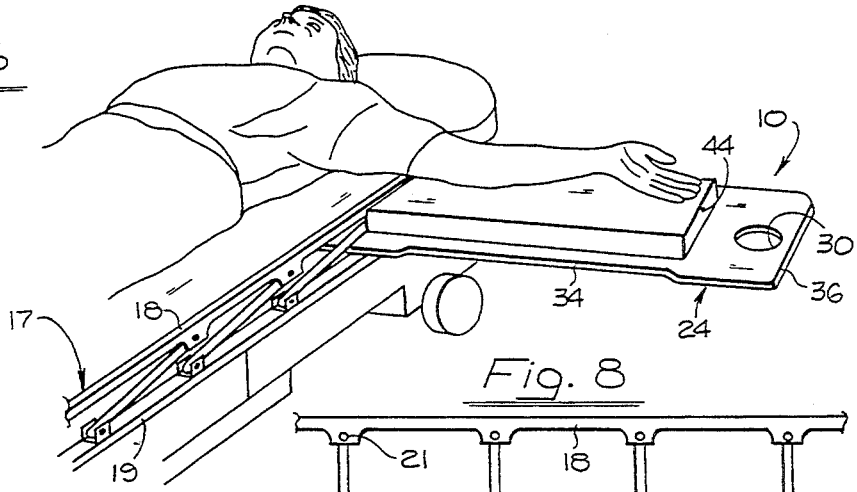
FIG. 6 is a perspective view showing the arm board in position on the gurney, and with a patient's arm supported thereon.

In using the arm board of the invention, it is put in place as depicted in FIGS. 3, 4, and 5. The near end 23 (FIG. 3) is inserted between the bed 14 and the cushion 15, and reference is again made to the adhesive stips 16. The spacing of the legs 38 of the arm board, accommodates these adhesive strips in that the legs are inserted in straddling relation to certain of them and between others, eliminating the necessity for removing them in order to insert the board, which would be necessary if the near end of the arm board would be continuous transversely, i.e. not having spaced legs. This spacing of the legs also accommodates the bars 20 of the side rails as referred to again below.

From the position illustrated in FIG. 3, the arm board is pushed inwardly to the position of FIG. 4. The arm board is dimensioned for accommodating this position, the legs 38 thus extending in length approximately the width of the cushion 18 (FIG. 7).

The arm board then extends transversely, with the remote end portion 26 extending laterally from the gurney as shown. Because the legs 38 extend substantially entirely the full width of the cushion, the weight of the patient is effective for holding the arm board in proper position. The weight of the cushion of course adds to this, even though to a minor extent. If desired, another cushion 44 may be placed on the arm board, to provide a level similar to the level of the first cushion, although this is not necessary. The second cushion 44 on the arm board (FIG. 5) is not a part of the device of the invention, but is used merely as convenience, and may be such an item as may be found in the immediate surroundings.

The hole 3 being positioned at the remote end of the arm board correspondingly supports the basin 32 at a position beyond the arm of the patient. This positioning of the basin is a great advantage, and indeed very important, for facilitating holding the basin, in a situation where, as is of course known, it is extremely important to avoid any unnecessary delays, and in otherwise accommodating the situation, such as having someone hold the basin.

The arm board may be made of any material desired, as noted, and because of its small dimensions, particularly its small thickness, it is relatively light in weight, and can be easily handled, as in putting it in position and removing it therefrom, and in putting it in a temporary storing place when not in use. Its minimum space accommodates so storing it.

Consideration is given to putting the arm board in position. When the side rails are in lower inactive position, the swinging ends of the bars 20 rest on the lower or pivoted ends of adjacent bars. The construction of the mounting of the bars is such that the legs 38 of the arm board will easily fit under the bars in their lowered position ( dot dash line FIG. 8), and of course the legs are spaced apart to straddle the bars and their mountings.

It is also possible, and practical, to put the arm board in place on the gurney, when the side rails are in upper active position, if it should be desired on occasion, where for example, an attendant may wish to put the arm board in place before the side rail is lowered, for convenience, and thereafter lower the side rail. This provides a great facility in handling the arm board, and putting it in position, to save time or for other reasons. Thus, a great advantage of the invention is pointed up that the arm board can be put into place quickly, regardless whether the side rail is in upper, or lower, position. The legs of the arm board fit in proper position, as referred to above, whether the bars 20 are upright or lowered, the legs being perfectly accommodated, and also the legs do not interfere at all with the movement of the bars.

I claim:

1. An arm board for use with a gurney having an elongated bed adapted to have a patient lying thereon, comprising, a thin elongated panel having a near end and a remote end, the panel being of flat shape, and having a uniform maximum thickness throughout its entire area except a small portion at its near end of less thickness, the panel having a major portion at its remote end which includes lateral elements constituting maximum width of the panel, the panel having legs at its near end, extending longitudinally and spaced apart laterally and having wedge shaped elements at their near ends which constitute said small portion of less thickness.

2. An arm board according to claim 1 wherein, the panel in its said major portion has side indentations midway of its length forming a corresponding narrow portion, and end sections constituting said maximum width elements, and the panel in its said major portion also having slots at the sides adjacent said side indentations, forming hand grips.

3. An arm board according the claim 2 wherein, the arm board is provided with a round hole adjacent its remote end for supporting a basin.

4. An arm board according to claim 1 in combination with a gurney that includes an elongated bed and a cushion on the bed, for supporting a patient, and also includes at its side edges, longitudinally spaced bars, wherein, the arm board is adapted to be mounted on the gurney transversely relative to their respective elongated dimensions, with the near end of the arm board on the gurney and positioned under the cushion, and the remote end extending laterally beyond one side of the gurney thereby functioning as a rest for the arm of the patient, said legs on the panel being spaced apart for straddling said bars, and said legs extending at least a substantial portion of the width of the bed.

* * * * *